United States Patent [19]

de Man

[11] Patent Number: 4,619,378

[45] Date of Patent: Oct. 28, 1986

[54] BEVERAGE DISPENSING APPARATUS

[76] Inventor: Heiko T. de Man, 7157 Hansen Dr., Dublin, Calif. 94568

[21] Appl. No.: 670,461

[22] Filed: Nov. 8, 1984

[51] Int. Cl.[4] ..... B67D 5/60

[52] U.S. Cl. ..... 222/144.5; 222/129.2; 222/484; 137/607; 137/884

[58] Field of Search ..... 222/129, 129.1–129.4, 222/144.5, 145, 135, 136; 137/884, 605–607

[56] References Cited

U.S. PATENT DOCUMENTS

| | | | |
|---|---|---|---|
| 3,168,967 | 2/1965 | Giampa | 222/129.1 |
| 3,800,826 | 12/1972 | McCann | 137/560 |
| 3,863,810 | 2/1975 | Hanson | 222/129.1 |
| 4,497,421 | 2/1985 | Schilling | 222/144.5 |

FOREIGN PATENT DOCUMENTS

| | | | |
|---|---|---|---|
| 1300072 | 12/1972 | United Kingdom | 137/884 |

OTHER PUBLICATIONS

Parsons, Alonzo R.; McGraw-Hill Yearbook of Science and Technology; "Fluidics"; 1968; pp. 11–19.

*Primary Examiner*—Joseph J. Rolla

*Assistant Examiner*—Michael S. Huppert

*Attorney, Agent, or Firm*—Townsend and Townsend

[57] ABSTRACT

Apparatus for dispensing beverages from a pressurized source of syrups and soda to be mixed in and discharged from a beverage dispensing head. The head includes a housing within which first, second and third valve blocks are amounted. The first valve block includes first and second sets of intersecting openings extending from first and second faces. Third and fourth openings extend into and through the second and third valve blocks. The openings all extend straight into the valve blocks so the valve blocks can be injected molded. The second, third and fourth openings define valve stem bores for reciprocally housing spring biased valve stems which have user accessible buttons mounted to the upper ends. The valve stems and valve stem bores define valves for controlling the flow of beverage components. The center button actuates the soda valve stem. The valve stems and associated buttons are coupled to one another through a plate mounted to the soda valve stem so that depressing any syrup button also depresses the soda valve stem, so both syrup and soda valves open, but pressing the soda button opens only the soda valve.

22 Claims, 6 Drawing Figures

BEVERAGE DISPENSING APPARATUS

BACKGROUND OF THE INVENTION

This invention relates to beverage dispensing apparatus of the type in which several different carbonated beverages are dispensed from a single beverage dispensing head by mixing soda and syrup at the head, the soda and syrup supplied to the head through a number of hoses from a pressurized beverage component source.

Hand held beverage dispensers which provide the operator with the ability to dispense a number of different carbonated beverages by merely pressing an appropriate button have become quite popular. An example of such a beverage dispensing apparatus is shown in U.S. Pat. No. 3,863,810 to Hanson. This patent discloses the use of dual-valve valve stems connected to each button. One of the valve elements on each of the valve stems controls fluid flow through a soda channel and the other valve element controls the flow of fluid through a syrup channel. Therefore, each button operates two valves to control the passage of syrup and soda from the pressurized beverage component source to the nozzle. To accommodate the two valves, four O-rings are required for each valve stem. Because of the numerous syrup and soda passageways required, the number of beverages accommodated in a chosen size dispensing head is limited. Also, since the four O-rings must be properly aligned, relatively tight manufacturing tolerances are necessary. Further, replacement of a worn or broken O-ring can be quite a problem with a dispensing head similar to that shown in Hanson.

The amount of beverage dispensed by one type of conventional beverage dispensers is determined by how long the button is depressed. Other conventional beverage dispensers are programmed to meter correct amounts of a beverage automatically. Regardless of how the amount is controlled, the proportion of soda to syrup must be controlled for each beverage. This is commonly done through the use of one or more brixing devices. Brixing devices typically use a valve, similar to a gate valve, in which two intersecting cylinders are used to control the flow through the valve. Since this type of valve lacks the ability to provide a positive shut off, depending upon the tightness of fit the brixing valve may allow syrup or soda to slowly leak past the brixing device and out the head.

SUMMARY OF THE INVENTION

The present invention is directed to a beverage dispensing apparatus which is easier and less expensive to manufacture and is smaller in size for the same number of syrups, compared with conventional beverage dispensing apparatus.

The beverage dispensing apparatus is of the type used with a source of beverage components including a common component, such as soda, and a number of individual components, such as syrups, under pressure. For simplicity the common beverage component will be referred to as soda while the individual components will be referred to as syrups. However, it is to be understood that such designature is for convenience and is not limiting. The apparatus includes a brixing device connecting the source of individual beverage components to a beverage dispensing head through a flexible line. The brixing device includes a number of passageways through which beverage components pass. The passageways preferably include a circular valve seat against which the tapered end of a movable brixing valve pin can seat to control the flow from the beverage component source to the beverage dispensing head. The brixing valve pin is typically threaded to the brixing device housing so that the relative flow of beverage components can be easily adjusted. The beverage components pass through individual hoses which make up the flexible line from the brixing device to the head.

The head includes a housing within which first, second and third valve blocks are mounted. The first valve block includes first openings, extending from a first face, which are fluidly connected to the outer ends of the hoses. Second openings are formed within the first block transverse to the first openings and intersect the first openings at appropriate positions. The second openings extend from a second face of the first valve block. The second and third valve blocks include third and fourth openings respectively extending into and through the second and third valve blocks.

The openings extending into the valve blocks all extend straight into the valve block so the valve blocks can be injected molded. The first, second and third valve blocks are mounted against one another with the second valve block abutting the second face of the first valve block and the second valve block sandwiched between the first and third valve blocks.

The second, third and fourth openings define valve stem bores for reciprocally housing valve stems therein. The valve stems extend outwardly past the third valve block and have user accessible buttons mounted to their outer ends. The buttons extend through openings within the housing. The valve stems and valve stem bores, along with appropriately placed O-rings discussed below, constitute valves for controlling the flow of beverage components through the valve stem bores and thus through the head. The valve stems are normally biased to their button up or retracted positions, thus closing the fluid pathways along the valve stem bores, by springs.

One button, typically the center button, actuates the valve stem that controls the flow of soda while the other buttons control the flow of syrups. The valve stems and associated buttons are coupled to one another through an actuator plate so that depressing one of the several syrup buttons also causes the soda valve stem to extend so both the syrup and soda valve stem bores open. However, the actuator plate is configured so that pressing the soda button alone does not cause any other valves to open.

In some cases it is desired to dispense a beverage, such as water or orange juice, without addition of soda. In such cases, the actuator plate is configured so the valve stem and button associated with the water and the orange juice are not coupled to the actuator plate, so pressing on either of such buttons does not open the soda valve.

The soda and syrups enter the valve stem bores from below, that is on the side of the valves opposite the buttons, their respective soda and syrup valves. When a valve stem is depressed the associated valve is open so a beverage component flows through the valve stem bore in the first and second valve blocks, reverses direction as it passes through a connecting conduit within the second valve block and then flows through syrup and soda discharge pathways formed completely through the first valve block. The syrup and soda are mixed in and then discharged from the nozzle.

A primary feature of the present invention is the use of a common soda valve operably coupled to the syrup valves so opening any syrup valve opens the soda valve as well. This substantially reduces the number of channels required in the valve block compared with prior art dispensing heads. This allows a greater number of syrups to be accommodated in the same size dispensing head.

Since each valve stem has only one valve, the valve housing can be made from three injected molded parts. In contrast with this, an injected molded valve housing of a prior art beverage dispenser, in which each valve stem has two valves, would likely require seven injected molded parts, many of the parts being relatively thin plates which are prone to warping.

Another significant advantage of the invention is that each valve requires only two seals, typically O-rings, in contrast to the four required with the dual-valve prior art beverage dispensers. This reduces the criticality of alignment since two O-rings will always align. In contrast, quite close tolerances, which raise cost, are required to insure that four O-rings align.

The invention preferably has both the syrups and the soda coming in from below their respective valve seats, that is on the side of the valve seats opposite the buttons. Thus the pressure from the individual beverage components tends to keep their respective valves closed when the valve stems are in the retracted or button up position.

Once a valve of applicant's invention is opened, that is with the valve stem in the extended or button down position, upon release of the button one spring must overcome the frictional resistance of one O-ring to urge the valve stem back to its retracted or button up position to close the valve. This is in contrast with the prior art dual-valve beverage dispensers in which a single spring must overcome the frictional resistance of two O-rings when closing the valve. It is not until the valves begin to close that the fluid pressure of the beverage components aids closing the valve.

Summarizing, the present invention, through the use of the common soda valve mechanically coupled to the syrup valves, eliminates the need for dual-valve valve stems and allows the valve housing to be made from three injected molded parts with straight-in channels. The single soda valve allows a greater number of beverages to be dispensed from the same size dispensing head compared with prior art dispensers. Since the beverage components all enter their entry chambers from below their spool valve member, the valves are self closing in the event a valve spring becomes weak or broken.

Other features and advantages will appear from the following description in which the preferred embodiment is set forth in detail with the accompanying drawings.

DETAILED DESCRIPTION OF THE PREFERRED EMBODIMENT

Figure 1:
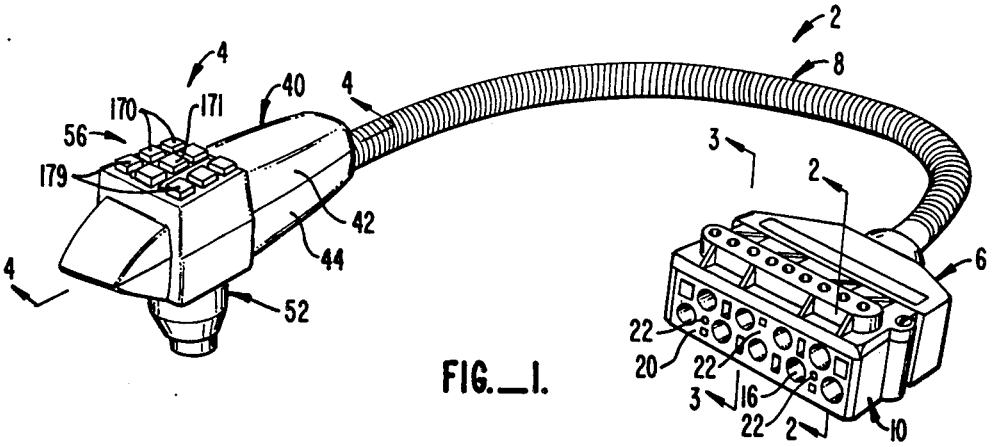
FIG. 1 is an overall perspective view of the beverage dispensing apparatus of the invention.

Referring now to FIG. 1, beverage dispensing apparatus 2 includes a beverage dispensing head 4 and a brixing device 6 coupled by a flexible line 8. Brixing device 6 is connected to a beverage component source, not shown, which supplies the brixing device with syrups and soda at elevated pressures.

Figure 2:
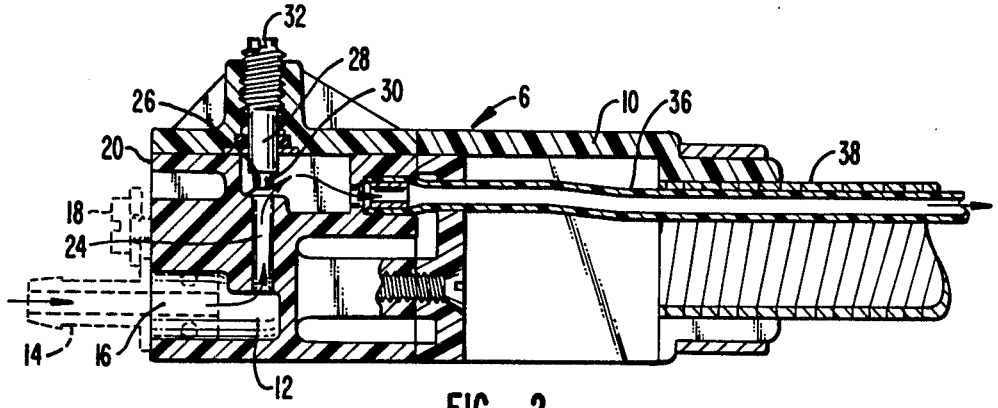
FIGS. 2 and 3 are cross-sectional views taken along lines 2—2 and 3—3 of the brixing device of the apparatus of FIG. 1.
Figure 3:
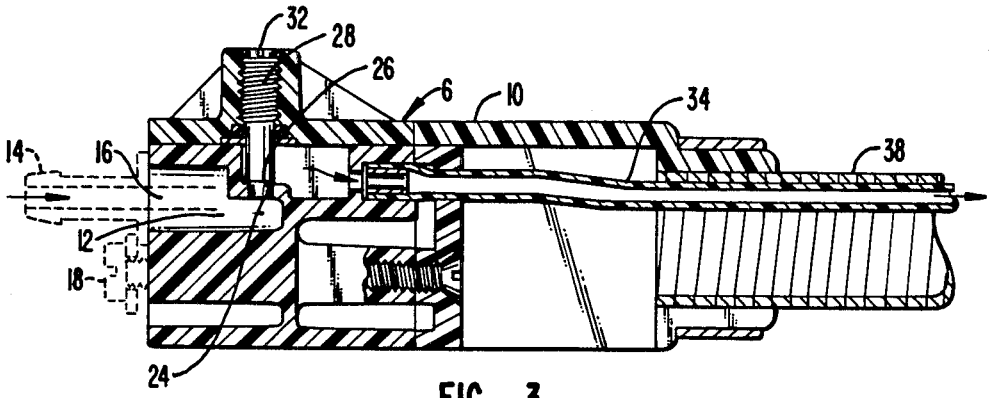

Referring now also to FIGS. 2 and 3, brixing device 6 is seen to include a housing 10 defining a number of passageways 12 therein. Syrups and soda flow from the beverage dispensing source through couplings 14, shown in dashed lines in FIGS. 2 and 3, mounted in opening 16 in housing 10. Couplings 14 are secured in place by screw and washer combinations 18, three of which are mounted to the face 20 of housing 10 through holes 22.

Portions 24 of passageways 12 are vertical and define circular valve seats 26. Aligned with portions 24 are brixing valve pins 28 having tapered end 30 sized to engage valve seats 26. Pins 28 are threadably mounted within housing 10 and include a slot 32 to allow the flow of liquid through passageway 12 to be adjusted. By tightening tapered end 30 against valve seat 26, a tight leak-proof seal is achieved along passageway 12.

Eight syrup hoses 34 and a single soda hose 36 are secured to housing 10 in fluid communication with respective passageways 12. Only one of either of these hoses 34, 36 are shown in FIGS. 2 and 3 for clarity. Hoses 34, 36 plus flexible metallic sheath 38 constitute flexible line 8.

Figure 4:
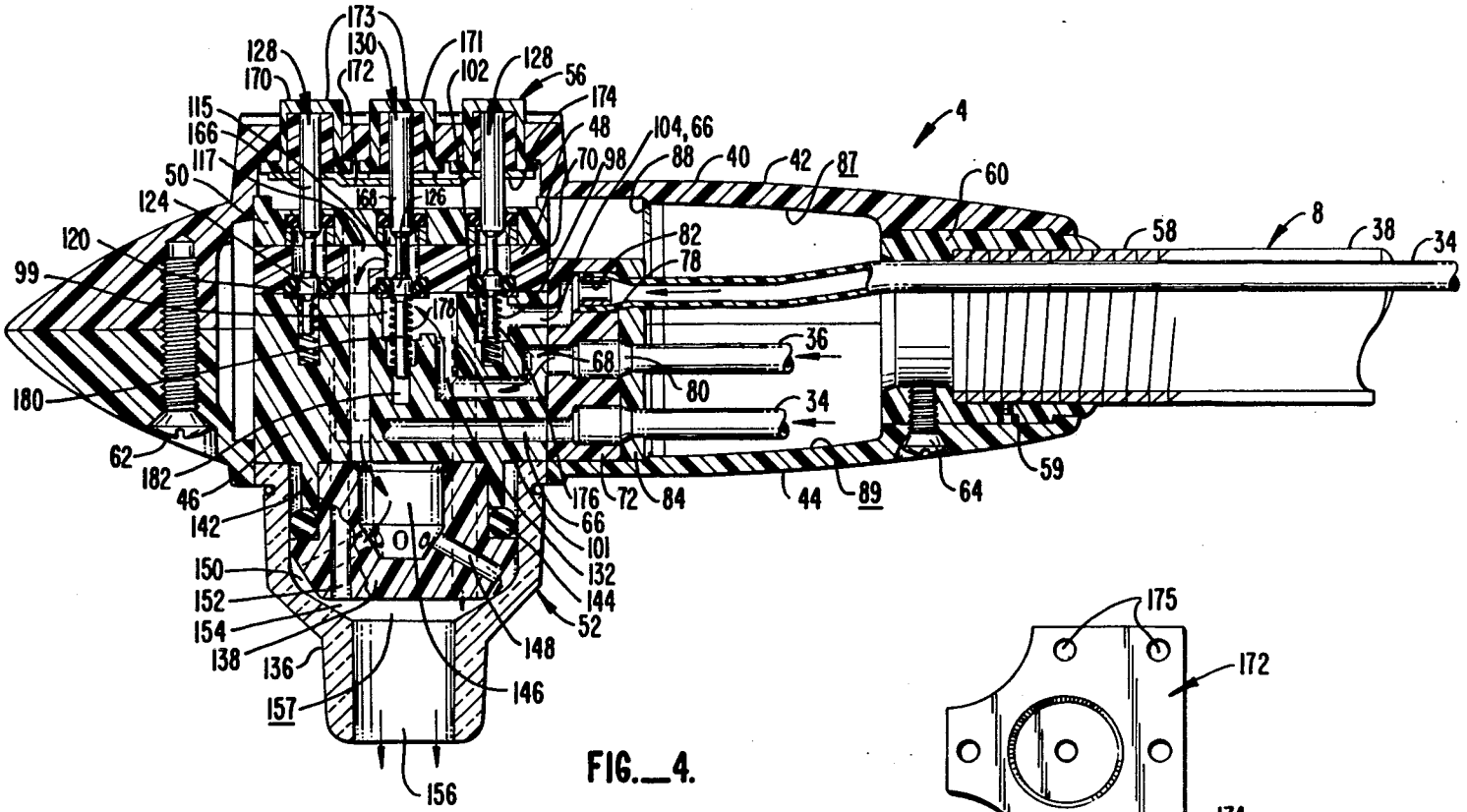
FIG. 4 is a longitudinal cross-sectional view taken along line 4—4 of FIG. 1 showing the operation of the beverage dispensing head.
Figure 5:
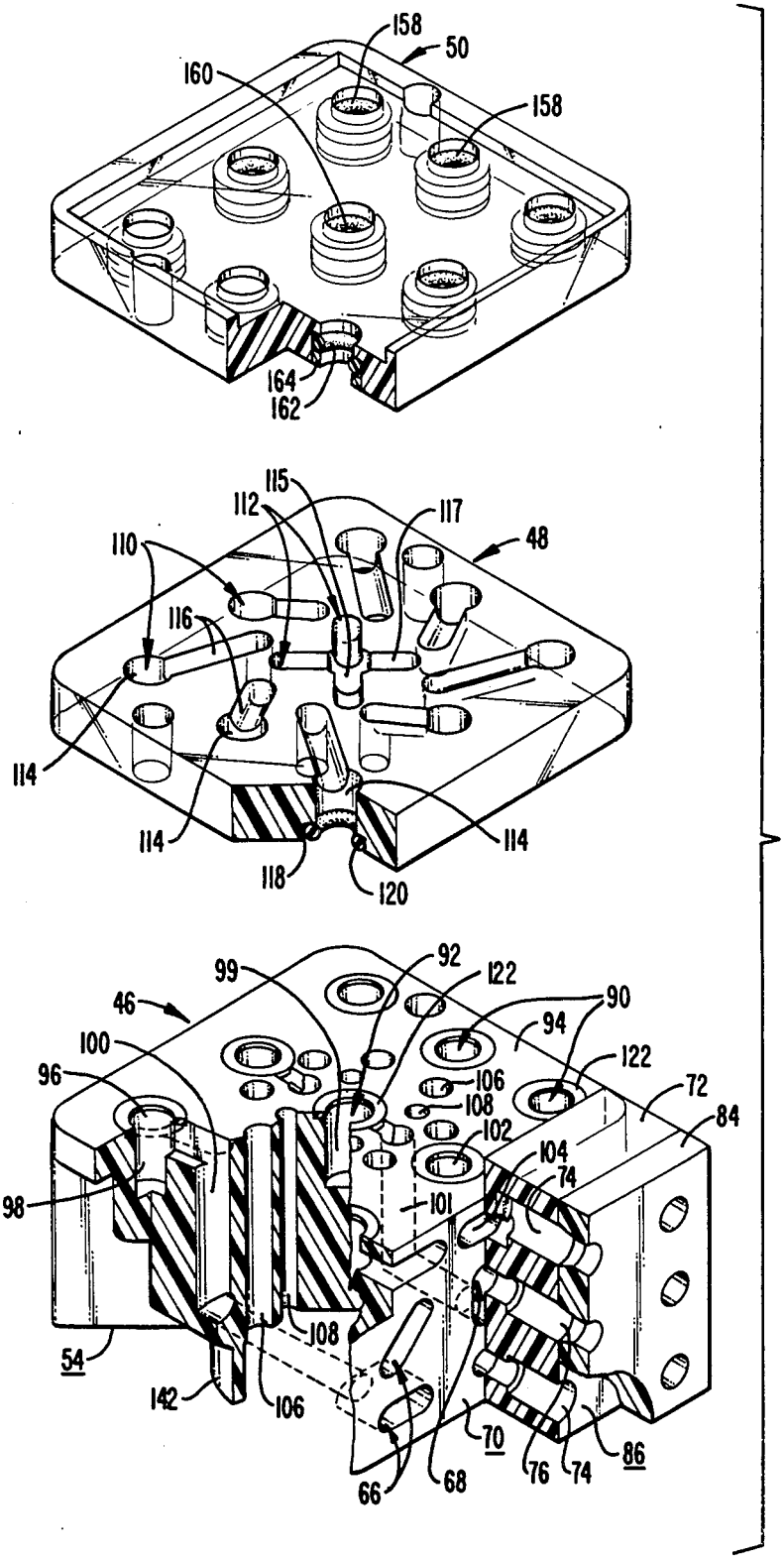
FIG. 5 is an exploded isometric view of the three valve blocks of FIG. 4 with portions broken away for clarity.

Turning now to FIGS. 4 and 5, beverage dispensing head 4 will be described. Head 4 includes a hollow two piece housing 40, having a top 42 and a bottom 44, housing first, second and third valve blocks 46, 48 and 50, a nozzle assembly 52 directly beneath the lower surface 54 of first valve block 46 and a button array 56 directly above third valve block 50. An outer end 58 of line 8 is secured to housing 40 through a set screw 59 passing through a connector sleeve 60 which is glued to top 42. Top and bottom 42, 44 are secured to one another by screws 62, 64.

Hoses 34, 36 are fluidly connected to the various syrup entrance openings 66 and soda entrance openings 68 formed at the first face 70 of first valve block 46. To accommodate the irregular spacings and shapes of opening 66, 68, an adapter plate 72 is secured against first face 70 such as with an adhesive. Plate 72 provides a number of regularly spaced circular openings 74, 76 for insertion of the outer ends 78, 80 of syrup and soda hoses 34, 36 respectively. Small metal ferrules 82 are mounted within outer ends 78, 80 so that the outer ends expand to fit openings 74, 76. A retainer plate 84 is placed against the outer surface 86 of adapter plate 72 with hoses 34, 36 passing snugly through openings in the retainer plate. Plate 84 is held in place against surface 86, thus keeping outer ends 78, 80 secured within openings 74, 76, by a circumferential abutment 88 formed on the inside surfaces 87, 89 of top 42 and bottom 44.

First openings 66, 68 extend straight into first valve block 46 from first face 70 until they intersect corresponding second syrup openings 90 and a second soda opening 92 which extend straight into block 46 from a second face 94 of first block 46. Most second openings, such as second syrup opening 96 and second soda opening 92, include lower syrup and soda valve chambers 98, 99 and L-shaped syrup and soda connecting portions 100, 101. However, it is to be noted that second openings 90, 92 extend straight into valve block 46 for ease of molding. Other second openings, such as opening 102, may be comprised of only of a lower valve chamber since its associated first opening 104 opens directly into opening 102. Second openings also include syrup discharge openings 106 and soda discharge openings 108 formed completely through first valve block 46.

Syrup discharge openings 106 are fluidly coupled to second syrup openings 90 through third syrup openings 110 in second valve block 48. All four soda discharge openings 108 are fluidly connected to second soda opening 92 by third soda openings 112 in second valve block 48.

Third syrup openings 110 include upper syrup and soda valve chambers 114, 115 and L-shaped syrup and soda connecting portions 116, 117. Upper chambers 114, 115 include an enlarged stepped region 118 in which O-rings 120 are mounted. O-rings 120 are captured between region 118 and washers 122 which are mounted in first valve block 46 to surround the tops of lower valve chambers 98, 99. Washers 122 keep O-rings 120 from entering L-shaped portions 100, 101. O-rings 120 provide the valve seat for cylindrical spool valve portions 124, 126 of syrup and soda valve pins 128, 130 respectively.

As is illustrated in FIG. 4, soda passes through soda hose 36, into first soda entrance 68, through L-shaped soda connecting portion 101 of second soda opening 92 and into lower soda valve chamber 99 of second soda opening 92. When soda valve pin 130 is in the button depressed or extended position, not shown, soda flows past O-ring 120 through upper soda valve chamber 115, after which it reverses direction in L-shaped soda connecting portions 117 and passes downwardly through the four soda discharge openings 108 for passage through nozzle assembly 52. The various syrups take similar routes but only pass through a single syrup discharge opening 106 to which the particular second syrup opening 90 is connected by its associated third syrup opening 110.

Nozzle assembly 52 includes an outer, hollow member 136 and an inner member 138 housed within outer member 136. Inner member 138 is cylindrical with its upper end cemented within a circular flange 142 extending from lower surface 54 of first valve block 46. Outer member 136 is mounted over inner member 138 and is secured to member 138 by an O-ring 144. O-ring 144 also acts as a seal between members 136, 138.

Inner member 138 includes a central soda receiving chamber 146 which is connected to the lower ends of all four of soda discharge openings 108. A number of angled passageways 148 connect chamber 146 with a region 150 between outer and inner members 136, 138. Syrup flows through syrup discharge openings 106 in first valve block 46 and to syrup passageways 152 connecting syrup discharge openings 106 through a mixing region 154 within outer member 136. Soda and syrup are mixed as the soda flows from region 150 through region 154 and out a discharge opening 156 in nozzle assembly 52.

Because of the restriction between regions 150 and 154, a slight back pressure is built-up within region 150 so that after the syrup stops flowing, some soda remains in region 150 to wash down the interior wall 157 of outer member 136. This helps to minimize residual syrup on interior surface 157 between uses. In some cases it may be desired to have the soda valve close a bit later than the syrup valves to further help wash syrup residue from nozzle assembly 52. This can be easily done by adjusting the location of soda spool valve portion 126 along soda valve pin 130.

Third valve block 50 includes fourth syrup openings 158 and fourth soda opening 160. Openings 158, 160 each have an enlarged lower region for housing an O-ring 162 which is kept in place by a positioning ring 164 which is pressed into openings 158, 160. O-rings 162 act as an upper seal for upper valve chambers 114, 115 by engaging the enlarged upper portions 166, 168 of valve pins 128, 130. Two part syrup and soda buttons 170, 171 are mounted to the enlarged upper portions 166, 168 of syrup and soda valve pins 128, 130. Buttons 170, 171 extend through appropriately placed openings in top 42 to form button array 56. Outer caps 173 of buttons 170, 171 are clear and separate from the rest of buttons 170, 171 to permit appropriate beverage identifying labels to be mounted within the buttons.

Figure 6:
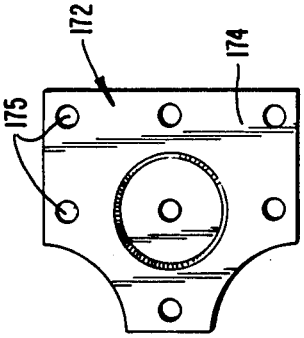
FIG. 6 is a plan view of the actuator plate of FIG. 4.

The center button is pressed to discharge soda while the other buttons are depressed to discharge carbonated beverages which is accomplished by mixing syrup and soda simultaneously within nozzle assembly 52. To keep from having to press both the soda and syrup buttons individually, an actuator plate 172, shown also in FIG. 6, is rigidly affixed to soda valve pin 130, such as by brazing. The periphery 174 of plate 172 has openings 175 loosely surrounding each of the enlarged upper syrup portions 166 of syrup valve pins 128. When soda valve button 171 is pushed only soda valve pin 130 moves. However, when one of syrup valve buttons 170 is depressed, the bottom of the syrup button 170 pushes down on the underlying periphery 174 of plate 172 thus opening two valves, the particular syrup valve actuated and the soda valve.

Plate 172 has two cut-out portions 177 which underlie buttons 179 of button array 56. Buttons 179 control the flow of beverages, such as water and orange juice, which are not mixed with soda. Cut-out portions 177 are sized so when either button 179 is depressed, button 179 does not contact plate 172 so only the beverage associated with that particular button 179 is delivered from head 4.

Valve pins 128, 130 are biased towards their retracted or button up positions by springs 176, 178. Springs 176, 178 are housed within lower valve chambers 98, 99 of second openings 90, 92. Soda valve pin 130 has an elongated lower end 180 which extends into a guide hole 182 within first valve block 46. This helps to counteract off axis forces on soda valve pin 130 which can be caused by pressing on one of the syrup buttons 170.

In use, brixing device 6 is coupled to a beverage component source through openings 16 at face 20. The proper mixture of syrup to soda is adjusted by rotating brixing valve pins 28 to achieve the desired degree of sweetness for each beverage. If plain soda is wanted, soda button 171 is depressed forcing soda valve pin 130 and actuator plate 172, but not syrup valve pins 128, to a button down or extended position. This opens the soda valve, allowing soda to flow through soda hose 36, first soda opening 68 and into lower soda valve chamber 99, past O-ring 120 and into upper valve chamber 115, through L-shaped connecting portions 117, through soda discharge openings 108 and into soda receiving chamber 146, through angled passageways 148 and into region 150, through region 154 and out discharge opening 156. If a beverage requiring a mixture of syrup and soda is desired, one presses a syrup button 170 which contacts the periphery 174 of actuator plate 172 to force the actuator plate and soda valve pin 130 to the retracted or button down position along with the depressed syrup valve pin 128. The syrup passes through first valve block 46 in a manner similar to that of the soda. Syrup enters its respective upper syrup valve chamber 114, passes through the connecting L-shaped syrup connecting portion 116, flows through one of the syrup discharge openings 106 passing through first valve block 46 and enters an underlying syrup passageway 152 within inner member 138 of nozzle assembly 52. The soda and syrup come together in mixing region 154 and are thoroughly mixed by the time they are discharged through opening 156. The interior wall 157 of nozzle 52 is washed down between beverages by the residual soda in chambers 146 and 150. If either of buttons 179 are depressed, the beverage associated with such button 179 is delivered in the same manner as syrups are delivered, but without the soda.

Modification and variation can be made to the disclosed embodiment without departing from the subject of the invention as defined in the following claims. For example, instead of having an actuator plate 172 rigidly mounted to soda valve pin 130, a pivot mounted or wobble plate could be used instead.

I claim:

1. A beverage dispensing head of the type for use with a pressurized source of soda and a number of syrups comprising:

a housing;

first, second and third valve blocks secured to one another and mounted within said housing;

said first block including a plurality of first and second openings, said first openings extending into said first block from a first face of said first block, said second openings extending into said first block from a second face of said first block, said first and second openings being transverse to one another, said first and second openings sized and positioned to intersect one another at chosen locations;

said second block having a third face mounted adjacent said second face of said first block and having a fourth face on the side of said second block opposite said third face, said second block including a plurality of third openings extending into said second block from said third and fourth faces;

said third block having fifth and sixth faces on opposite sides thereof and a plurality of fourth openings extending into said third block from said fifth and sixth faces;

syrup spool valve stems and a soda spool valve stem, said syrup and soda spool valve stems each having a cylindrical valve seat surface;

said second, third and fourth openings defining syrup and soda valve stem bores for reciprocally housing said syrup and soda valve stems therein for movement between extended and retracted positions;

valve seats positioned along said valve stem bores against which said valve seat surfaces press when respective syrup and soda valve stems are in retracted positions to close said valve stem bores;

means for biasing said syrup valve stems toward said retracted positions;

said syrup and soda valve stem bores including syrup and soda entry and exit chambers, said entry chambers positioned on one side of said valve seats and said exit chambers positioned on the other side of said valve seats; and means for fluidly connecting said syrup and soda exit chambers to a discharge opening.

2. The dispensing head of claim 1 wherein said first and second openings, said third openings and said fourth openings extend straight into said first, second and third blocks respectively so said blocks can be molded members with said openings formed therein during molding.

3. The dispensing head of claim 1 further comprising means for operably coupling at least one of said syrup valve stems to said soda valve stem so movement of said at least one syrup valve stem from its retracted position to its extended position moves said soda valve stem from its retracted position to its extended position as well.

4. The dispensing head of claim 3 wherein said stem operably coupling means includes a plate fixed to said soda valve stem.

5. The dispensing head of claim 1 wherein said entry chambers are formed in said first block and said exit chambers are formed in said second block.

6. The apparatus of claim 5 wherein said exit chambers fluidly connecting means are formed in said second block.

7. The apparatus of claim 1 wherein said second openings include syrup and soda discharge pathways which constitute at least a portion of said exit chamber connecting means.

8. The dispensing head of claim 1 wherein the syrup and soda exit chambers connecting means include straight discharge bores extending from the second face of the first block completely through the first block along paths generally parallel to the soda valve stem.

9. A beverage dispensing apparatus of the type for use with a pressurized source of soda and a number of syrups comprising:

a beverage dispensing head; and means for fluidly coupling said head to the soda and syrup source, said coupling means including a plurality of syrup hoses and a soda hose;

said dispensing head including:

a housing;

soda and syrup buttons, corresponding to the soda and the syrups, mounted to the housing for access by a user;

first, second and third valve blocks secured to one another and mounted within said housing beneath said buttons;

said first block including a plurality of first and second openings, said first openings extending into said first block from a first face of said first block, said second openings extending into said first block from a second face of said first block, said first and second openings being transverse to one another, said first and second openings sized and positioned to intersect one another at chosen locations, said first and second openings extending straight into said first block so said first block can be a molded member with said first and second openings formed therein during molding;

said second block having a third face mounted adjacent said second face of said first block and having a fourth face on the side of said second block opposite said third face, said second block including a plurality of third openings extending generally straight into said second block from said third and fourth faces so said second block can be molded with said third openings formed therein during molding;

said third block having fifth and sixth faces on opposite sides thereof and a plurality of fourth openings extending generally straight into said third block from said fifth and sixth faces so said third block can be molded with said fourth openings formed therein during molding, said fifth face of said third block mounted to said fourth face of said second block;

a syrup valve stem connected to each of said syrup spool buttons and a soda valve stem connected to said soda spool button, said syrup and soda valve stems each having a cylindrical valve seat surface;

said second, third and fourth openings defining syrup and soda valve stem bores for reciprocally housing said syrup and soda valve stems therein for movement between extended and retracted positions;

said second openings including syrup and soda discharge pathways;

a discharge nozzle mounted to said housing in fluid communication with said discharge pathways;

valve seats positioned along said valve stem bores against which said valve seat surfaces press when respective syrup and soda valve stems are in retracted positions to close said valve stem bores;

means for operably coupling at least one said syrup valve stem to said soda valve stem so movement of said at least one syrup valve stem from its retracted position to its extended position moves said soda valve stem from its retracted position to its extended position as well;

said syrup and soda valve stem bores including syrup and soda entry and exit chambers, said entry chambers positioned on one side of said valve seats and said exit chambers positioned on the other side of said valve seats;

means for fluidly connecting said syrup and soda exit chambers to said syrup and soda discharge pathways respectively;

means for biasing said valve stems and said buttons therewith toward said retracted positions; and means for fluidly connecting said soda and syrup hoses to said first openings at said first face of said first block.

10. The apparatus of claim 9 wherein said soda and syrup source fluidly coupling means includes a brixing device for selectively, adjustably and individually controlling the flow of the syrups and soda along said syrup and soda hoses.

11. The apparatus of claim 10 wherein said brixing device includes:

a housing;

a plurality of flow paths, defined within said housing, for said syrups and soda, each said flow path including a circular valve seat; and a plurality of valve pins threadably mounted to said housing, each said valve pin having a tapered end sized for sealing engagement against a respective valve seat.

12. The apparatus of claim 9 wherein said stem operably coupling means includes a plate fixed to said soda valve stem.

13. The apparatus of claim 12 wherein said plate includes syrup button engaging portions sized to be engaged by the button mounted to said at least one syrup stem when said at least one stem and button combination is moved from its retracted position to its extended position but not to movably engage said at least one stem and button combination otherwise.

14. The apparatus of claim 9 wherein said stem operably coupling means operably couples each said syrup stem to said soda stem.

15. The apparatus of claim 9 wherein said valve blocks are mounted within said housing between said buttons on one side and said discharge nozzle on an opposite side.

16. The apparatus of claim 9 wherein said valve seats are positioned in the portions of said valve stem bores formed within said second valve block.

17. The apparatus of claim 9 wherein said valve seats are formed by O-rings mounted along said valve stem bores.

18. The apparatus of claim 9 wherein said exit chambers of at least some of said valve stem bores are on the side of their associated valve seats toward said buttons so the fluids in said entrance chambers of said at least some valve stem bores supplement the biasing of said valve stem biasing means when said valve stems are in their retracted positions.

19. The apparatus of claim 18 wherein all of said exit chambers are on the sides of their associated valve seats toward said buttons.

20. The apparatus of claim 9 wherein said entry chambers are formed in said first block and said exit chambers are formed in said second block.

21. The apparatus of claim 9 wherein said exit chambers fluidly connecting means are formed in said second block.

22. The apparatus of claim 9 wherein said syrup and soda discharge pathways pass straight through said first block.

* * * * *